US010161420B2

(12) United States Patent
Bai et al.

(10) Patent No.: US 10,161,420 B2
(45) Date of Patent: Dec. 25, 2018

(54) FAN

(71) Applicant: Huawei Technologies Co., Ltd., Shenzhen (CN)

(72) Inventors: Lei Bai, Shenzhen (CN); Lexiong Peng, Shenzhen (CN); Dong Wang, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 391 days.

(21) Appl. No.: 14/938,152

(22) Filed: Nov. 11, 2015

(65) Prior Publication Data

US 2016/0131160 A1 May 12, 2016

(30) Foreign Application Priority Data

Nov. 12, 2014 (CN) ..... 2014 1 0635555

(51) Int. Cl.

| | |
|---|---|
| ***F04D 25/12*** | (2006.01) |
| ***F04D 29/66*** | (2006.01) |
| ***F04D 25/06*** | (2006.01) |
| ***F04D 29/52*** | (2006.01) |
| ***F04D 29/68*** | (2006.01) |

(Continued)

(52) U.S. Cl.

CPC ..... *F04D 29/664* (2013.01); *F04D 19/002* (2013.01); *F04D 25/0613* (2013.01); *F04D 25/0693* (2013.01); *F04D 25/12* (2013.01); *F04D 29/325* (2013.01);

(Continued)

(58) Field of Classification Search

CPC .... F04D 29/526; F04D 29/664; F04D 19/002; F04D 25/0613; F04D 25/0693; F04D 23/12; F04D 29/325; F04D 29/522; F04D 29/667; F04D 29/685

See application file for complete search history.

(56) References Cited

U.S. PATENT DOCUMENTS 3,947,148 A 3/1976 Holt
5,096,013 A * 3/1992 Yoshida ..... B60V 1/14 180/116

(Continued)

FOREIGN PATENT DOCUMENTS

CN 202441625 U 9/2012
CN 202851455 U 4/2013

(Continued)

OTHER PUBLICATIONS

Foreign Communication From a Counterpart Application, European Application No. 15194048.3, Extended European Search Report dated Mar. 7, 2017, 5 pages.

(Continued)

*Primary Examiner* — Philip Stimpert
(74) *Attorney, Agent, or Firm* — Conley Rose, P.C.

(57) ABSTRACT

A fan, including a volute, a motor, and multiple fan blades that are assembled on a rotor of the motor, where the volute includes a side wall that is disposed around circumference of the multiple fan blades, and a support frame that is connected to an end of the side wall and located on an inner side of the side wall; and the rotor of the motor drives the multiple fan blades to rotate, where multiple through-holes are disposed on the side wall of the volute, and at least more than one of the multiple through-holes is a slant through-hole.

44 Claims, 6 Drawing Sheets

(51) Int. Cl.
*F04D 19/00* (2006.01)
*F04D 29/32* (2006.01)

(52) U.S. Cl.
CPC ..... *F04D 29/522* (2013.01); *F04D 29/526* (2013.01); *F04D 29/667* (2013.01); *F04D 29/685* (2013.01)

(56) References Cited

U.S. PATENT DOCUMENTS 5,297,617 A 3/1994 Herbert
5,551,841 A 9/1996 Kamada
5,707,206 A * 1/1998 Goto ..... F01D 11/10 415/173.1
5,761,085 A * 6/1998 Giorgio ..... G06F 1/206 361/679.4
6,179,562 B1 * 1/2001 Fujinaka ..... F04D 29/164 415/119
8,068,339 B2 * 11/2011 Kayama ..... F04D 25/0613 165/121
2005/0281665 A1 12/2005 Horng et al.
2008/0053749 A1 * 3/2008 Utsunomiya ..... G03B 21/16 181/286
2008/0259564 A1 10/2008 Kayama et al.
2011/0277957 A1 11/2011 Kuo
2012/0027577 A1 * 2/2012 Takemoto ..... F04D 25/0613 415/203
2012/0164003 A1 6/2012 Liu et al.

FOREIGN PATENT DOCUMENTS

DE 19523339 A1 6/1995
DE 19523339 A1 1/1996
GB 908521 A 10/1962
GB 1514584 A 10/1975
GB 1514584 A 6/1978
GB 2330624 A 4/1999
TW 515530 U 12/2002
WO 2011076030 A1 6/2011

OTHER PUBLICATIONS

Foreign Communication From a Counterpart Application, Chinese Application No. 201410635555.3, Chinese Office Action dated May 5, 2016, 5 pages.
Foreign Communication From a Counterpart Application, Chinese Application No. 201410635555.3, Chinese Search Report dated Apr. 23, 2016, 2 pages.
Foreign Communication From a Counterpart Application, European Application No. 15194048.3, Extended European Search Report dated Apr. 8, 2016, 6 pages.

* cited by examiner

FAN

CROSS-REFERENCE TO RELATED APPLICATION

This application claims priority to Chinese Patent Application No. 201410635555.3, filed on Nov. 12, 2014, which is hereby incorporated by reference in its entirety.

TECHNICAL FIELD

The present disclosure relates to the field of electronic communications technologies, and in particular, to a fan.

BACKGROUND

As the Information and Communications Technology (ICT) industry continuously develops, performance such as a capacity and density of a product such as a router, a switch, or a server is continuously improved, and power of an entire device is continuously increasing. To meet a requirement of a large air volume for dissipating heat for a core component in the entire device, a fan speed is accordingly improved. In this way, noise generated by a fan becomes relatively large and a noise problem of the entire system is increasingly severe. Therefore, seeking a measure for effectively reducing the noise of the fan is one of urgent to-be-resolved problems in sustained development of the entire device in future.

SUMMARY

In view of this, embodiments of the present disclosure provide a fan, so as to decrease noise generated by the fan when the fan runs.

According to a first aspect, the present disclosure provides an embodiment of a fan, where the fan includes a volute, a motor, and multiple fan blades that are assembled on a rotor of the motor, where the volute includes a side wall that is disposed around the multiple fan blades, and a support frame that is connected to an end of the side wall and located on an inner side of the side wall; the support frame includes a support part, and multiple ribs that are connected to circumference of the support part; one end of the multiple ribs is connected to the support part, and the other end is connected to the inner side of the side wall; and the motor is fastened to the support part, and the rotor of the motor drives the multiple fan blades to rotate, where multiple through-holes are disposed on the side wall of the volute, and at least more than one of the multiple through-holes is a slant through-hole.

In a first possible implementation manner of the first aspect, an included angle Φ between a tangent plane or a tangent line at which an inner wall or an outer wall of the side wall of the volute intersects with an inner wall of the slant through-hole, and the inner wall of the slant through-hole is an acute angle or an obtuse angle.

With reference to the first possible implementation manner of the first aspect, in a second possible implementation manner, the included angle Φ is less than or equal to 85 degrees, or the included angle Φ is greater than or equal to 95 degrees.

In a third possible implementation manner of the first aspect, an included angle θ between a tangent line or a tangent plane at which an inner wall or an outer wall of the side wall of the volute intersects with an axis of the slant through-hole, and the axis of the slant through-hole is an acute angle or an obtuse angle.

With reference to the third possible implementation manner of the first aspect, in a fourth possible implementation manner, the included angle θ is less than or equal to 85 degrees, or the included angle θ is greater than or equal to 95 degrees.

With reference to the first aspect, or the first or the second or the third or the fourth possible implementation manner of the first aspect, in a fifth possible implementation manner, axes of at least some slant through-holes of the multiple slant through-holes are parallel.

With reference to the first aspect, or the first or the second or the third or the fourth or the fifth possible implementation manner of the first aspect, in a sixth possible implementation manner, an area that has the through-holes and that is of the side wall of the volute includes a ribbon area A of the side wall of the volute, where as a position continuously changes in a process of rotation of the multiple fan blades, a total area that all projections projected on the side wall of the volute occupy on the side wall of the volute is the ribbon area A.

With reference to the sixth possible implementation manner of the first aspect, in a seventh possible implementation manner, the area that has the through-holes and that is of the side wall of the volute further includes ribbon areas that are located on two sides of the ribbon area A and occupy a width of L/2 in a height direction of the side wall of the volute, where a width occupied in the height direction of the side wall of the volute by the area A is L.

With reference to the first aspect, or the first or the second or the third or the fourth or the fifth or the sixth or the seventh possible implementation manner of the first aspect, in an eighth possible implementation manner, a diameter of the through-hole is less than or equal to 3 millimeters (mm), and an allowable error range is ±20%.

With reference to the first aspect, or the first or the second or the third or the fourth or the fifth or the sixth or the seventh possible implementation manner of the first aspect, in a ninth possible implementation manner, a diameter of the slant through-hole is less than or equal to 3 mm, and an allowable error range is ±20%.

With reference to the first aspect, or the first or the second or the third or the fourth or the fifth or the sixth or the seventh or the eighth or the ninth possible implementation manner of the first aspect, in a tenth possible implementation manner, a quantity of slant through-holes disposed on the volute accounts for at least 20% of a total quantity of the disposed through-holes.

With reference to the first aspect, or the first or the second or the third or the fourth or the fifth or the sixth or the seventh or the eighth or the ninth or the tenth possible implementation manner of the first aspect, in an eleventh possible implementation manner, the fan further includes a sound absorption material coated on an outer side of the side wall of the volute.

With reference to the first aspect, or the first or the second or the third or the fourth or the fifth or the sixth or the seventh or the eighth or the ninth or the tenth or the eleventh possible implementation manner of the first aspect, in a twelfth possible implementation manner, the fan further includes a sound absorption material filled in the multiple through-holes of the side wall of the volute.

According to a second aspect, the present disclosure further provides an embodiment of a communications device, where the communications device includes an air channel, an electronic circuit, and a fan, where heat of the electronic device is taken away by flowing of airflow in the air channel; the fan is configured to promote the flowing of the airflow in the air channel, and the fan includes a volute, a motor, and multiple fan blades that are assembled on a rotor of the motor, where the volute includes a side wall that is disposed around circumference of the multiple fan blades, and a support frame that is connected to an end of the side wall and located on an inner side of the side wall; the support frame includes a support part, and multiple ribs that are connected to circumference of the support part; one end of the multiple ribs is connected to the support part, and the other end is connected to the inner side of the side wall; and the motor is fastened to the support part, and the rotor of the motor drives the multiple fan blades to rotate, where multiple through-holes are disposed on the side wall of the volute, and at least more than one of the multiple through-holes is a slant through-hole.

In a first possible implementation manner of the second aspect, an included angle Φ between a tangent plane or a tangent line at which an inner wall or an outer wall of the side wall of the volute intersects with an inner wall of the slant through-hole, and the inner wall of the slant through-hole is an acute angle or an obtuse angle.

With reference to the first possible implementation manner of the second aspect, in a second possible implementation manner, the included angle Φ is less than or equal to 85 degrees, or the included angle Φ is greater than or equal to 95 degrees.

In a third possible implementation manner of the second aspect, an included angle θ between a tangent line or a tangent plane at which an inner wall or an outer wall of the side wall of the volute intersects with an axis of the slant through-hole, and the axis of the slant through-hole is an acute angle or an obtuse angle.

With reference to the third possible implementation manner of the second aspect, in a fourth possible implementation manner, the included angle θ is less than or equal to 85 degrees, or the included angle θ is greater than or equal to 95 degrees.

With reference to the second aspect, or the first or the second or the third or the fourth possible implementation manner of the second aspect, in a fifth possible implementation manner, axes of at least some slant through-holes of the multiple slant through-holes are parallel.

With reference to the second aspect, or the first or the second or the third or the fourth or the fifth possible implementation manner of the second aspect, in a sixth possible implementation manner, an area that has the through-holes and that is of the side wall of the volute includes a ribbon area A of the side wall of the volute, where as a position continuously changes in a process of rotation of the multiple fan blades, a total area that all projections projected on the side wall of the volute occupy on the side wall of the volute is the ribbon area A.

With reference to the sixth possible implementation manner of the second aspect, in a seventh possible implementation manner, the area that has the through-holes and that is of the side wall of the volute further includes ribbon areas that are located on two sides of the ribbon area A and occupy a width of L/2 in a height direction of the side wall of the volute, where a width occupied in the height direction of the side wall of the volute by the area A is L.

With reference to the second aspect, or the first or the second or the third or the fourth or the fifth or the sixth or the seventh possible implementation manner of the second aspect, in an eighth possible implementation manner, a diameter of the through-hole is less than or equal to 3 mm, and an allowable error range is ±20%.

With reference to the second aspect, or the first or the second or the third or the fourth or the fifth or the sixth or the seventh possible implementation manner of the second aspect, in a ninth possible implementation manner, a diameter of the slant through-hole is less than or equal to 3 mm, and an allowable error range is ±20%.

With reference to the second aspect, or the first or the second or the third or the fourth or the fifth or the sixth or the seventh or the eighth or the ninth possible implementation manner of the second aspect, in a tenth possible implementation manner, a quantity of slant through-holes disposed on the volute accounts for at least 20% of a total quantity of the disposed through-holes.

With reference to the second aspect, or the first or the second or the third or the fourth or the fifth or the sixth or the seventh or the eighth or the ninth or the tenth possible implementation manner of the second aspect, in an eleventh possible implementation manner, the fan further includes a sound absorption material coated on an outer side of the side wall of the volute.

With reference to the second aspect, or the first or the second or the third or the fourth or the fifth or the sixth or the seventh or the eighth or the ninth or the tenth or the eleventh possible implementation manner of the second aspect, in a twelfth possible implementation manner, the fan further includes a sound absorption material filled in the multiple through-holes of the side wall of the volute.

The foregoing technical solutions have the following advantages.

When a fan works properly, there is airflow in a blade tip clearance that leaks from a high pressure surface to a low pressure surface, and a leakage of the airflow generates a leakage vortex, where the leakage vortex is one of noise sources of the fan. Airflow of the leakage vortex generated by the fan is alleviated by using multiple through-holes, particularly multiple slant through-holes, disposed on a volute. In this way, holes on the volute, particularly the slant through-holes, can weaken the airflow of the leakage vortex, and therefore noise may be reduced.

In addition, noise reduction in a manner of disposing multiple through-holes, particularly multiple slant through-holes, on the volute does not require an increase in a volume of the fan. When the fan having a noise reduction function in the embodiments of the present disclosure is installed on a device, compared with another fan that does not have the noise reduction function, it is not required to increase additional accommodation space for the device, and particularly additional deep space of the device does not need to be occupied, thereby facilitating a compact layout of the device.

Moreover, the noise reduction manner provided in the embodiments of the present disclosure is to take a noise reduction measure at a position relatively close to a noise source. Because a distance closer to a sound source indicates more sound energy received and more remarkable reduction of sound energy, noise reduction efficiency is relatively high.

Furthermore, by using the noise reduction manner provided in the embodiments of the present disclosure, at the same time when noise is reduced, performance of the fan is not compromised and a heat dissipation capability of a system is not affected. In addition, by using the noise reduction manner provided in the embodiments of the present disclosure, an installation position of the fan does not need to be reconstructed. A new fan provided in the embodiments of the present disclosure can be used and installed in a device in which an existing fan can be used and installed, thereby facilitating replacement and upgrade of the fan.

BRIEF DESCRIPTION OF DRAWINGS

To describe the technical solutions in the embodiments of the present disclosure or in the prior art more clearly, the following briefly introduces the accompanying drawings required for describing the embodiments or the prior art. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
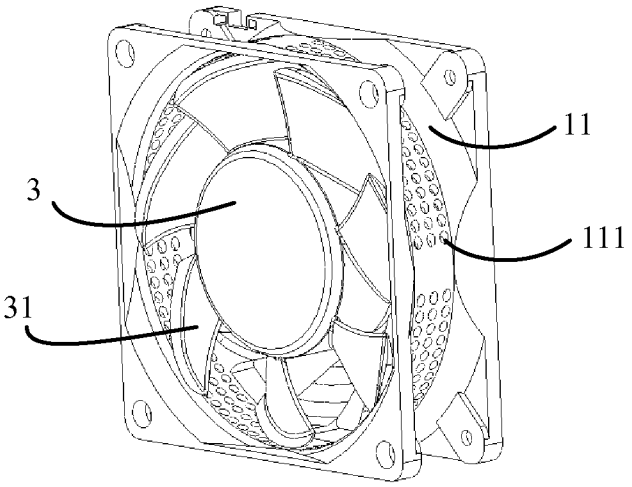
FIG. 1 is a schematic diagram of a front view of an embodiment of a fan according to the present disclosure.
Figure 2:
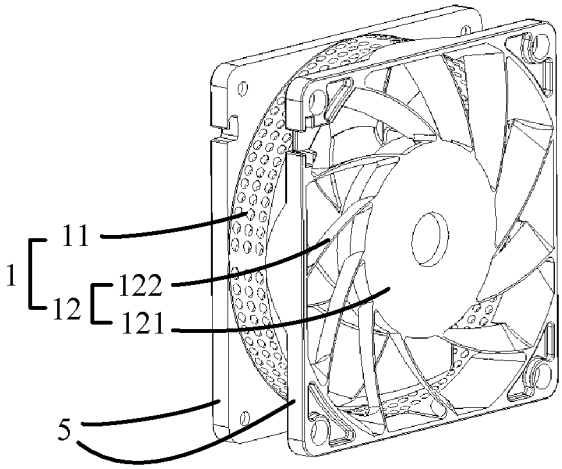
FIG. 2 is a schematic diagram of a rear view of an embodiment of a fan according to the present disclosure.

As shown in FIG. 1 and FIG. 2, an embodiment of the present disclosure provides a fan, where the fan includes a volute 1, a motor 3, and multiple fan blades 31 that are assembled on a rotor of the motor 3, where the volute 1 includes a side wall 11 that is disposed around circumference of the multiple fan blades 31, and a support frame 12 that is connected to an end of the side wall 11 and located on an inner side of the side wall 11; the support frame 12 includes a support part 121, and multiple ribs 122 that are connected to circumference of the support part 121; one end of the multiple ribs 122 is connected to the support part 121, and the other end is connected to the inner side of the side wall 11; and the motor 3 is fastened to the support part 121, and the rotor of the motor 3 drives the multiple fan blades 31 to rotate, where multiple through-holes 111 are disposed on the side wall 11 of the volute 1, and at least more than one of the multiple through-holes 111 is a slant through-hole.

Figure 3:
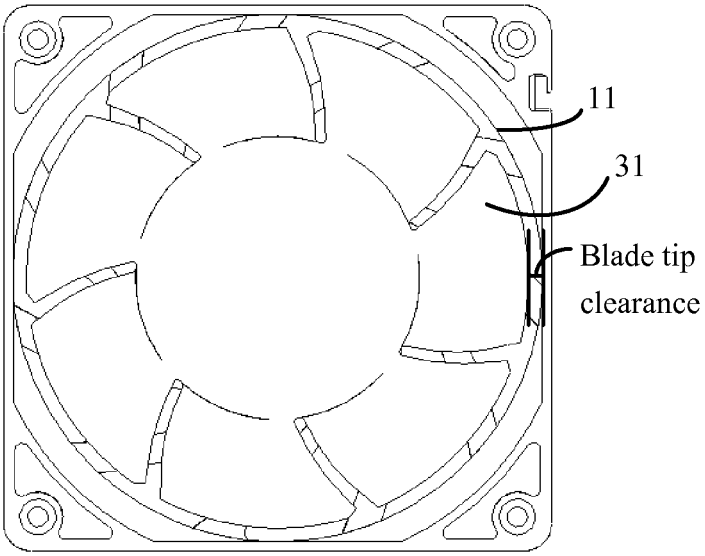
FIG. 3 is a schematic diagram of a blade tip clearance of an embodiment of a fan according to the present disclosure.

As shown in FIG. 3, in the foregoing embodiment of the present disclosure, a clearance exists between the fan blade 31 and the inner side of the side wall 11 of the volute, and is referred to as a blade tip clearance. When the fan works properly, there is airflow in the blade tip clearance that leaks from a high pressure surface to a low pressure surface, and a leakage of the airflow generates a leakage vortex, where the leakage vortex is one of noise sources of the fan. Airflow of the leakage vortex generated by the fan is alleviated by using multiple through-holes, particularly multiple slant through-holes, disposed on the volute. In this way, holes on the volute, particularly the slant through-holes can weaken the airflow of the leakage vortex, and therefore noise may be reduced.

In addition, noise reduction in a manner of disposing multiple through-holes, particularly multiple slant through-holes, on the volute does not require an increase in a volume of the fan. When the fan having a noise reduction function in this embodiment of the present disclosure is installed on a device, compared with another fan that does not have the noise reduction function, it is not required to increase additional accommodation space for the device, and particularly additional deep space of the device does not need to be occupied, thereby facilitating a compact layout of the device.

Moreover, the noise reduction manner provided in this embodiment of the present disclosure is to take a noise reduction measure at a position relatively close to a noise source. Because a distance closer to a sound source indicates more sound energy received and more remarkable reduction of sound energy, noise reduction efficiency is relatively high.

Furthermore, by using the noise reduction manner provided in this embodiment of the present disclosure, at the same time when noise is reduced, performance of the fan is not compromised and a heat dissipation capability of a system is not affected. In addition, by using the noise reduction manner provided in this embodiment of the present disclosure, an installation position of the fan does not need to be reconstructed. A new fan provided in the embodiments of the present disclosure can be used and installed in a device in which an existing fan can be used and installed, thereby facilitating replacement and upgrade of the fan.

Figure 4:
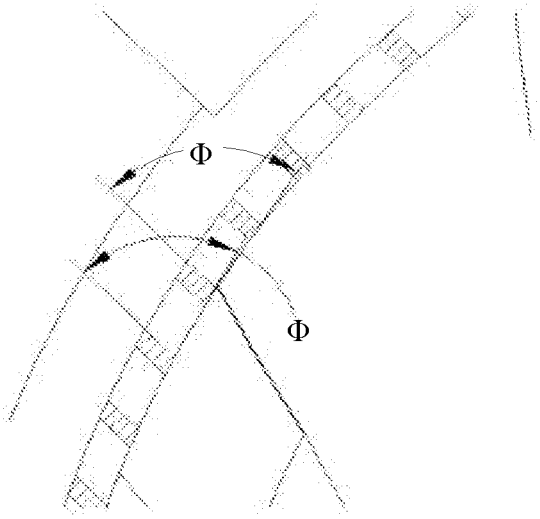
FIG. 4 and FIG. 5 are schematic diagrams of a slant degree of a slant through-hole of an embodiment of a fan according to the present disclosure.
Figure 5:
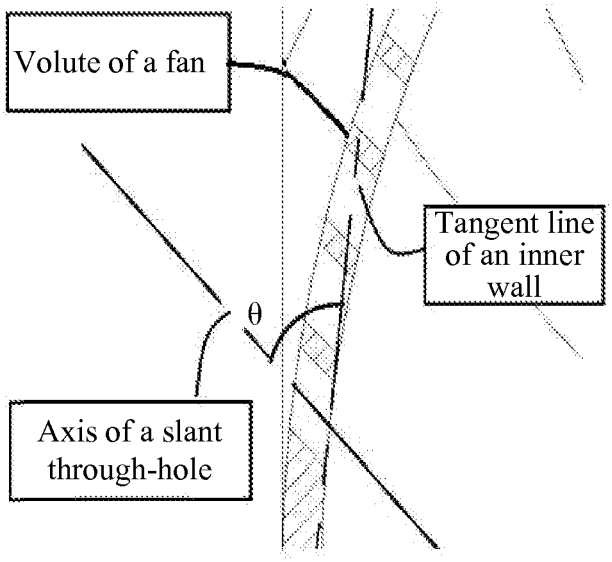

Further, as shown in FIG. 4 and FIG. 5, in the foregoing embodiment of the present disclosure, an included angle $\Phi$ between a tangent plane or a tangent line at which an inner wall or an outer wall of the side wall of the volute intersects with an inner wall of the slant through-hole, and the inner wall of the slant through-hole is an acute angle or an obtuse angle; or an included angle $\theta$ between a tangent line or a tangent plane at which an inner wall or an outer wall of the side wall of the volute intersects with an axis of the slant through-hole, and the axis of the slant through-hole is an acute angle or an obtuse angle.

Further, in the foregoing embodiment of the present disclosure, the included angle $\theta$ may be less than or equal to 85 degrees, or the included angle $\theta$ may be greater than or equal to 95 degrees.

Further, in the foregoing embodiment of the present disclosure, the included angle $\theta$ may be less than or equal to 85 degrees, or the included angle $\theta$ may be greater than or equal to 95 degrees.

Further, in the foregoing embodiment of the present disclosure, axes of at least some slant through-holes of the multiple slant through-holes are parallel.

Figure 6:
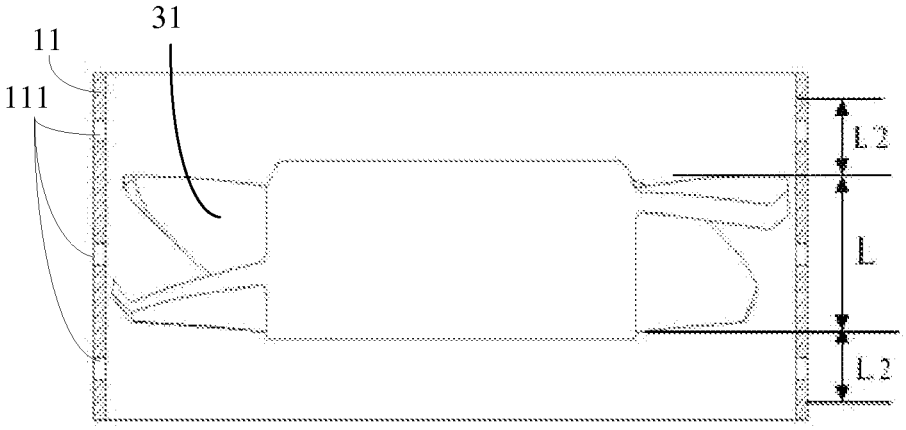
FIG. 6 is a schematic diagram of a layout area of a through-hole of an embodiment of a fan according to the present disclosure.

Further, as shown in FIG. 6, in the foregoing embodiment of the present disclosure, an area that has the through-holes 111 and that is of the side wall 11 of the volute includes a ribbon area A of the side wall 11 of the volute, where as a position continuously changes in a process of rotation of the multiple fan blades 31, a total area that all projections projected on the side wall 11 of the volute occupy on the side wall 11 of the volute is the ribbon area A.

Further, the area that has the through-holes 111 and that is of the side wall 11 of the volute may further include ribbon areas that are located on two sides of the ribbon area A and occupy a width of L/2 in a height direction of the side wall 11 of the volute, where a width occupied in the height direction of the side wall 11 of the volute by the area A is L.

Further, in the foregoing embodiment of the present disclosure, a diameter of the through-hole may be less than or equal to 3 mm, and an allowable error range may be ±20%.

Further, in the foregoing embodiment of the present disclosure, a diameter of the slant through-hole may be less than or equal to 3 mm, and an allowable error range may be ±20%.

Further, in the foregoing embodiment of the present disclosure, among the multiple through-holes, diameters of the multiple slant through-holes may be different from diameters of other through-holes.

Further, in the foregoing embodiment of the present disclosure, a shape of a cross section of the through-hole may be a regular shape or an irregular shape, for example, may be a circle, an ellipse, a rectangle, a triangle, or a horn-like shape.

Further, in the foregoing embodiment of the present disclosure, a quantity of slant through-holes disposed on the volute accounts for at least 20% of a total quantity of the disposed through-holes.

Further, in the foregoing embodiment of the present disclosure, slant directions of the multiple slant through-holes may be the same or may be different.

Further, in the foregoing embodiment of the present disclosure, included angles θ of the multiple slant through-holes may be the same or may be different.

Further, in the foregoing embodiment of the present disclosure, included angles Φ of the multiple slant through-holes may be the same or may be different.

Further, in the foregoing embodiment of the present disclosure, when the rotor of the motor drives the multiple fan blades to rotate, a rotation axis of the multiple fan blades is parallel with the side wall of the volute.

Further, in the foregoing embodiment of the present disclosure, an outer rim of a cross section of the side wall of the volute is a circle or an equilateral regular polygon.

Further, as shown in FIG. 2, in the foregoing embodiment of the present disclosure, the volute 1 further includes two flanges 5, where the two flanges 5 are separately located at two ends of the side wall 11 of the volute 1, and separately extend from outer sides of the two ends of the side wall 11. In addition, the flanges 5 and end faces of the two ends of the side wall 11 are parallel with each other or located on a same plane, and outer rims of cross sections of the flanges 5 are rectangular.

Figure 7:
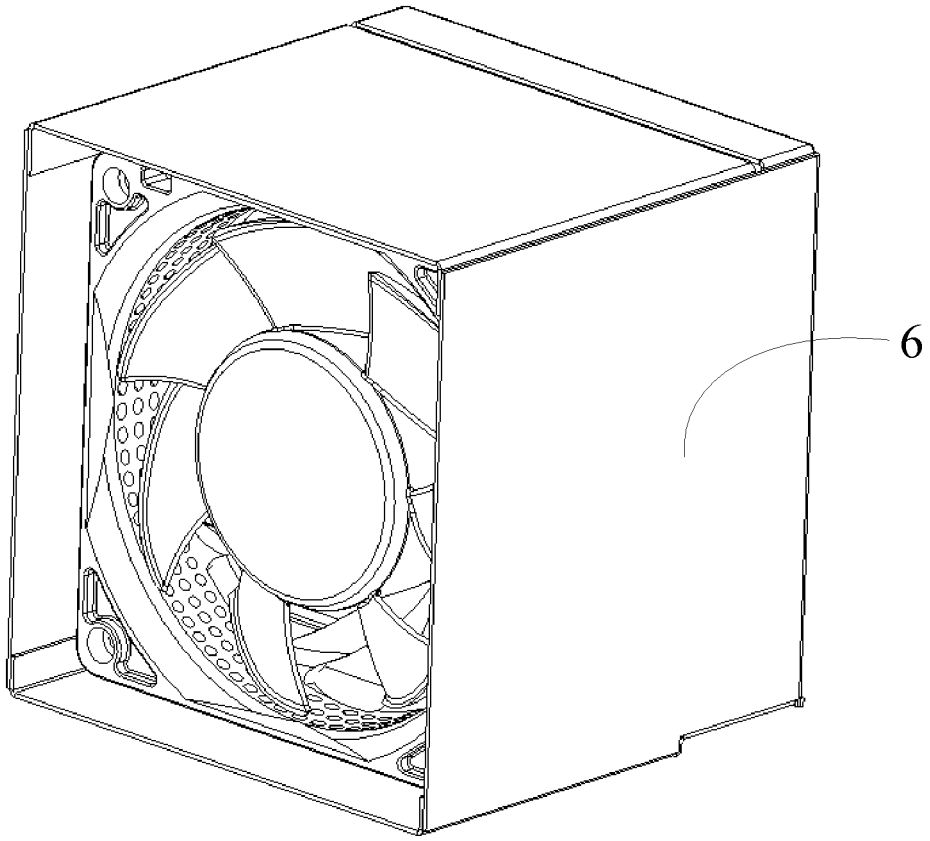
FIG. 7 is a schematic diagram of a fan assembly of an embodiment of a fan according to the present disclosure.

Further, as shown in FIG. 7, in the foregoing embodiment of the present disclosure, the fan may further include a fan assembly 6. Referring to FIG. 2 as well, the fan assembly 6 is located on an outer side of the volute 1, and the volute 1 is installed inside the fan assembly 6 by using the flanges 5.

Figure 8:
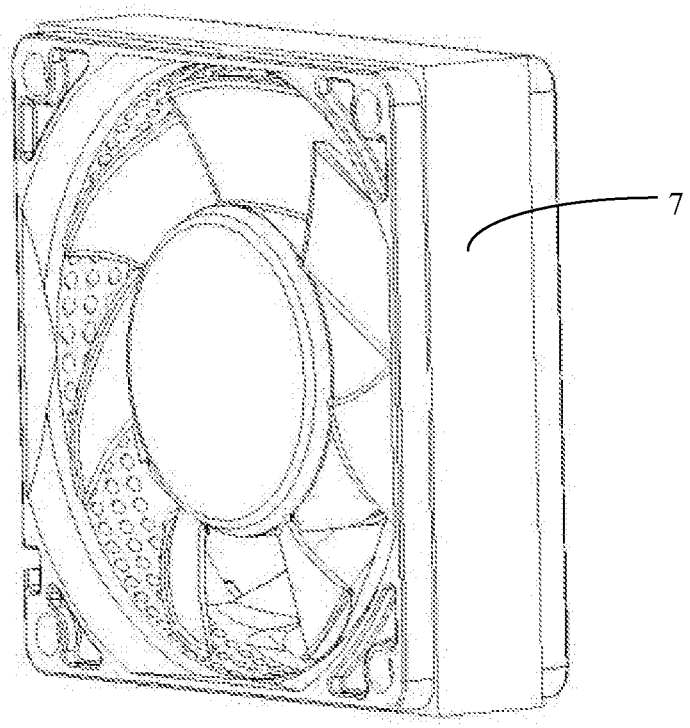
FIG. 8 and FIG. 9 are schematic diagrams of a sound absorption material of an embodiment of a fan according to the present disclosure.
Figure 9:
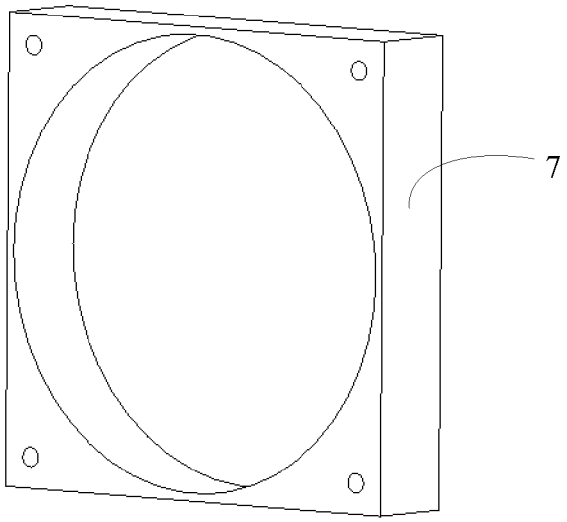

Further, as shown in FIG. 8 and FIG. 9, the fan provided in this embodiment of the present disclosure may further include a sound absorption material 7. Referring to FIG. 2 as well, the sound absorption material 7 is coated on an outer side of the side wall 11 of the volute 1. Noise generated by the fan may be evenly radiated outward from the volute of the fan by using the through-holes, particularly the slant through-holes, disposed on the volute. In a propagation process, a part of noise is absorbed by the sound absorption material 7. In this way, noise at an air intake vent and air exhaust vent of the fan may be weakened. In addition, the sound absorption material 7 may also plug up the through-holes of the side wall of the volute, so that performance of the fan is not affected because fan pressure is leaked by holes disposed on the volute.

Further, in the foregoing embodiment of the present disclosure, the sound absorption material may further be filled in the multiple through-holes of the side wall of the volute.

Further, in the foregoing embodiment of the present disclosure, the sound absorption material may be a sound absorption sponge, a foam material, or the like.

The fan in the foregoing embodiment of the present disclosure may be various fans such as an axial flow fan, a centrifugal fan, a mixed flow fan, or cross-flow fan.

Figure 10:
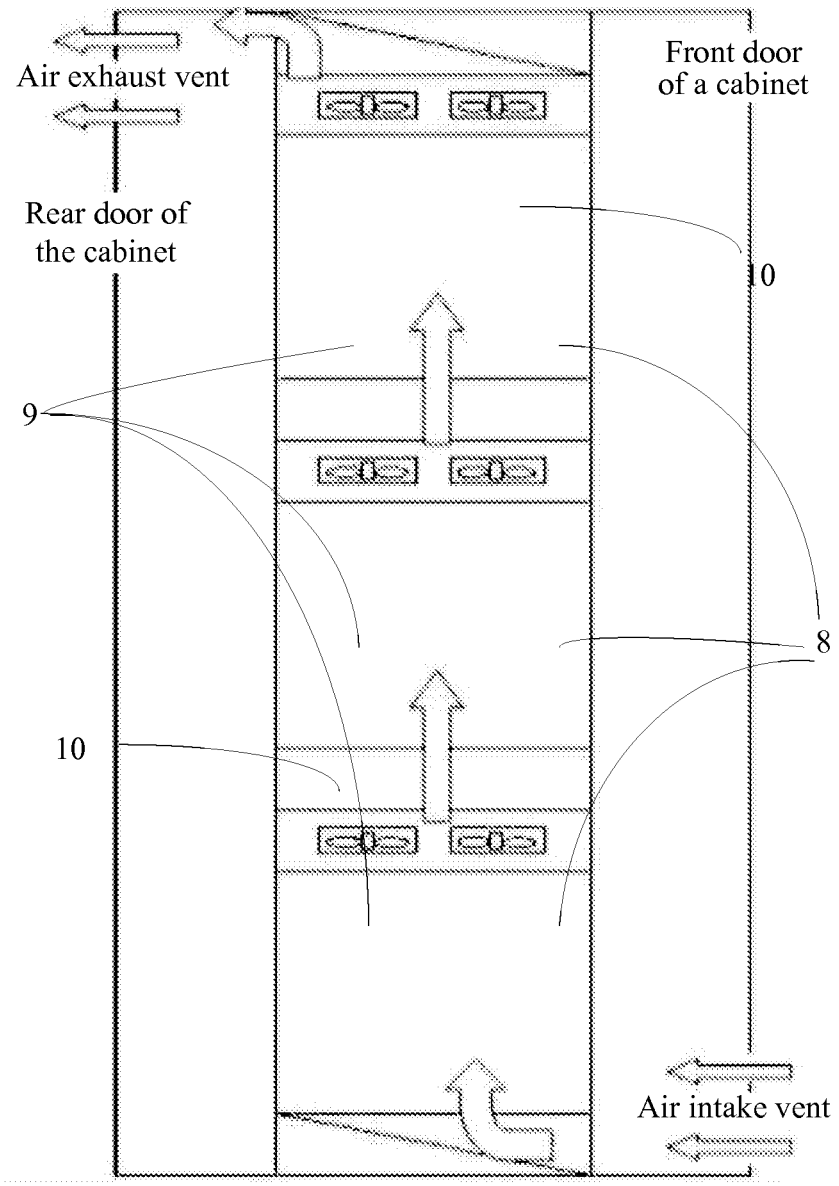
FIG. 10 is a schematic diagram of an embodiment of a communications device according to the present disclosure.

As shown in FIG. 10, FIG. 1, and FIG. 2, the present disclosure further provides an embodiment of a communications device, where the communications device includes an air channel 8, an electronic circuit 9, and a fan 10, where heat of the electronic device is taken away by flowing of airflow (the arrows in the diagram are used to indicate a direction of the airflow) in the air channel 8; the fan 10 is configured to promote the flowing of the airflow in the air channel 8, and the fan 10 includes a volute 1, a motor 3, and multiple fan blades 31 that are assembled on a rotor of the motor 3, where the volute 1 includes a side wall 11 that is disposed around circumference of the multiple fan blades 31, and a support frame 12 that is connected to an end of the side wall 11 and located on an inner side of the side wall 11; the support frame 12 includes a support part 121, and multiple ribs 122 that are connected to circumference of the support part 121; one end of the multiple ribs 122 is connected to the support part 121, and the other end is connected to the inner side of the side wall 11; and the motor 3 is fastened to the support part 121, and the rotor of the motor 3 drives the multiple fan blades 31 to rotate, where multiple through-holes 111 are disposed on the side wall 11 of the volute 1, and at least more than one of the multiple through-holes 111 is a slant through-hole.

Further, in the foregoing embodiment of the communications device in the present disclosure, the fan 10 may be disposed at an air intake vent or an air exhaust vent of the air channel 8, or disposed inside the air channel 8.

The fan in the embodiment of the communications device in the present disclosure may use the implementation manners in the foregoing embodiment of the fan, and has effects of the implementation manners in the foregoing embodiment of the fan.

The communications device in the embodiment of the communications device provided in the present disclosure may be a device such as a router, or a data center, or a switch, or a server.

What is claimed is:

1. A fan comprising:

a motor comprising a rotor;

multiple fan blades assembled on the rotor, the rotor driving the multiple fan blades to rotate, and the rotor having a rotor axis; and a volute comprising:

a side wall disposed around the multiple fan blades and comprising multiple through-holes, at least two of the multiple through-holes being slant through-holes having an axis and a circular cross-section that has a constant diameter throughout the side wall, and the diameter being less than or equal to 3.6 millimeters; and a support frame connected to an end of the side wall and located on an inner side of the side wall, the support frame comprising:

a support part fastened to the motor; and multiple ribs, each comprising:

one end connected to a circumference of the support part; and another end connected to the inner side of the side wall.

2. The fan of claim 1, wherein an included angle Φ between a tangent plane or a tangent line at which an inner wall or an outer wall of the side wall of the volute intersects with an inner wall of one of the slant through-holes and the inner wall of the one slant through-hole is an acute angle.

3. The fan of claim 2, wherein the included angle Φ is less than or equal to 85 degrees.

4. The fan of claim 2, wherein the included angle Φ of all of the slant through-holes is the same.

5. The fan of claim 1, wherein an included angle θ between the axis and a tangent line or a tangent plane at which an inner wall or an outer wall of the side wall intersects the axis of one of the slant through-holes is an acute angle.

6. The fan of claim 5, wherein the included angle θ is less than or equal to 85 degrees.

7. The fan of claim 5, wherein the included angle θ of all of the slant through-holes is the same.

8. The fan of claim 1, wherein axes of at least some of the slant through-holes are parallel.

9. The fan of claim 1, wherein an area that has the through-holes and that is of the side wall of the volute comprises a ribbon area A of the side wall of the volute, and as a position continuously changes in a process of rotation of the multiple fan blades, a total area of all projections of the multiple fan blades onto the side wall of the volute occupy on the side wall of the volute is the ribbon area A.

10. The fan of claim 9, wherein the area that has the through-holes and that is of the side wall of the volute further comprises ribbon areas that are located on two sides of the ribbon area A and occupy a width of L/2 in a height direction of the side wall of the volute, and a width occupied along the rotor axis of the side wall of the volute by the area A is L.

11. The fan of claim 1, wherein a diameter of the through-holes is from 2.4 millimeters to 3.6 millimeters.

12. The fan of claim 1, wherein a quantity of slant through-holes-accounts for at least 20% of a total quantity of the through-holes.

13. The fan of claim 1, wherein the fan further comprises a sound absorption material coated on an outer side of the side wall of the volute.

14. The fan of claim 1, wherein the fan further comprises a sound absorption material filled in the multiple through-holes of the side wall of the volute.

15. The fan of claim 1, wherein any two adjacent slant through-holes are not parallel.

16. The fan of claim 1, wherein the axes of any two adjacent slant through-holes are not parallel.

17. The fan of claim 1, wherein none of the axes intersect the rotor axis.

18. The fan of claim 1, wherein a diameter of the slant through-holes is 3.6 millimeters.

19. The fan of claim 1, wherein an included angle Φ between a tangent plane or a tangent line at which an inner wall or an outer wall of the side wall of the volute intersects with an inner wall of one of the slant through-holes and the inner wall of the one slant through-hole is an obtuse angle.

20. The fan of claim 19, wherein the included angle Φ is greater than or equal to 95 degrees.

21. The fan of claim 1, wherein an included angle θ between the axis and a tangent line or a tangent plane at which an inner wall or an outer wall of the side wall of the volute intersects with the axis of one of the slant through-holes is an obtuse angle.

22. The fan of claim 21, wherein the included angle θ is greater than or equal to 95 degrees.

23. A communications device comprising:

an electronic circuit;

an air channel configured to take heat away from the electronic circuit by flowing an air flow in the air channel; and a fan configured to promote the flowing of the airflow in the air channel, the fan comprising:

a motor comprising a rotor, the rotor comprising a rotor axis;

multiple fan blades that are assembled on the rotor, the rotor driving the multiple fan blades to rotate; and a volute comprising:

a side wall that is disposed around the multiple fan blades and comprising multiple through-holes, at least two of the multiple through-holes being slant through-holes having an axis and a circular cross-section that has a constant diameter throughout the side wall, and the diameter being less than or equal to 3.6 millimeters; and a support frame that is connected to an end of the side wall and located on an inner side of the side wall, the support frame comprising:

a support part fastened to the motor; and multiple ribs, each comprising:

one end connected to a circumference of the support part; and another end connected to the inner side of the side wall.

24. The communications device of claim 23, wherein an included angle Φ between a tangent plane or a tangent line at which an inner wall or an outer wall of the side wall of the volute intersects with an inner wall of one of the slant through-holes and the inner wall of the one slant through-hole is an acute angle.

25. The communications device of claim 24, wherein the included angle Φ is less than or equal to 85 degrees.

26. The communications device of claim 24, wherein the included angle Φ of all of the slant through-holes is the same.

27. The communications device of claim 23, wherein an included angle θ between the axis and a tangent line or a tangent plane at which an inner wall or an outer wall of the side wall of the volute intersects with of one of the slant through-holes the axis is an acute angle.

28. The communications device of claim 27, wherein the included angle θ is less than or equal to 85 degrees.

29. The communications device of claim 27, wherein the included angle θ of all of the slant through-holes are the same.

30. The communications device of claim 23, wherein an area that has the through-holes and that is of the side wall of the volute comprises a ribbon area A of the side wall of the volute, and as a position continuously changes in a process of rotation of the multiple fan blades, a total area of all projections of the multiple fan blades onto the side wall of the volute occupy on the side wall of the volute is the ribbon area A.

31. The communications device of claim 30, wherein the area that has the through-holes and that is of the side wall of the volute further comprises ribbon areas that are located on two sides of the ribbon area A and occupy a width of L/2 in a height direction of the side wall of the volute, and a width occupied along the rotor axis of the side wall of the volute by the area A is L.

32. The communications device of claim 23, wherein a diameter of the through-holes is from 2.4 millimeters to 3.6 millimeters.

33. The communications device of claim 23, wherein axes of at least some of the slant through-holes are parallel.

34. The communications device of claim 23, wherein a quantity of slant through-holes accounts for at least 20% of a total quantity of the through-holes.

35. The communications device of claim 23, wherein the fan further comprises a sound absorption material coated on an outer side of the side wall of the volute.

36. The communications device of claim 23, wherein the fan further comprises a sound absorption material filled in the multiple through-holes of the side wall of the volute.

37. The communications device of claim 23, wherein any two adjacent slant through-holes are not parallel.

38. The communications device of claim 23, wherein the axes of any two adjacent slant through-holes are not parallel.

39. The communications device of claim 23, wherein none of the axes intersect the rotor axis.

40. The communications device of claim 23, wherein a diameter of the slant through-holes is 3.6 millimeters.

41. The communications device of claim 23, wherein an included angle Φ between a tangent plane or a tangent line at which an inner wall or an outer wall of the side wall of the volute intersects with an inner wall of one of the slant through-holes and the inner wall of the one slant through-hole is an obtuse angle.

42. The communications device of claim 41, wherein the included angle Φ is greater than or equal to 95 degrees.

43. The communications device of claim 23, wherein an included angle θ between the axis and a tangent line or a tangent plane at which an inner wall or an outer wall of the side wall of the volute intersects with of one of the slant through-holes the axis is an obtuse angle.

44. The communications device of claim 43, wherein the included angle θ is greater than or equal to 95 degrees.

* * * * *